US005162048A

United States Patent [19]

Diaz-Valdes

[11] Patent Number: 5,162,048

[45] Date of Patent: Nov. 10, 1992

[54] ADDITIVE FOR HYDROCARBON FUELS

[75] Inventor: Samuel Diaz-Valdes, Mendeza, Chile

[73] Assignee: Kirsten, Inc., Tortola, British Virgin Isls.

[21] Appl. No.: 569,642

[22] Filed: Aug. 20, 1990

[30] Foreign Application Priority Data

Sep. 27, 1989 [AR] Argentina ..... 315024

[51] Int. Cl.[5] ..... C10L 1/22; C10L 1/18

[52] U.S. Cl. ..... 44/324; 44/323; 44/325; 44/326; 564/281; 564/292; 564/503

[58] Field of Search ..... 44/323, 324, 325, 326; 564/503, 281, 292

[56] References Cited

U.S. PATENT DOCUMENTS

| | | | |
|---|---|---|---|
| 3,272,879 | 9/1966 | Stahly | 260/688 |
| 3,904,508 | 9/1975 | Whyte et al. | 208/17 |
| 4,131,434 | 12/1978 | Gonzalez | 44/62 |
| 4,177,768 | 12/1979 | Davis | 44/57 |
| 4,185,594 | 1/1980 | Perilstein | 44/326 |
| 4,223,642 | 9/1980 | Okubo | 123/1 A |
| 4,370,147 | 1/1983 | Kenny et al. | 44/68 |
| 4,417,903 | 11/1983 | Hinkamp | 44/326 |
| 4,448,587 | 5/1984 | Hinkamp et al. | 44/324 |
| 4,594,077 | 6/1986 | Zaweski et al. | 44/57 |
| 4,936,932 | 6/1990 | Nevyen | 149/2 |

FOREIGN PATENT DOCUMENTS

| | | | |
|---|---|---|---|
| 451801 | 10/1948 | Canada | 44/324 |

OTHER PUBLICATIONS

CA 97(10): 79872v.

*Primary Examiner*—Ellen McAvoy
*Attorney, Agent, or Firm*—Charles E. Temko

[57] ABSTRACT

The present invention relates to an additive to hydrocarbon fuels which includes nitrate of ethanolamine as an additive to reduce the quantity of smoke and improve the efficiency of combustion. The invention also relates to a process for the preparation of this additive and of the fuels improved by the addition of the additive.

8 Claims, No Drawings

ADDITIVE FOR HYDROCARBON FUELS

BACKGROUND OF THE INVENTION

In the prior art, various means have been developed for reducing environmental contamination due to incomplete or deficient combustion of hydrocarbon fuels, including the use of fuels containing contaminants, especially sulfur and derivatives of this element, such as SH2 and mercaptans, in which the process of combustion generates SO2 and SO3, the effects of which are well known. This aspect of the environmental contamination has been faced and to a great extent solved, by subjecting the fuel to a process of desulfurization, with the object of reducing the sulfur content to tolerable limits.

The improvement of uncontaminated fuel has been the object of many investigations and trials with the object of reducing the emissions of $CO_2$, nitrogen oxides, soot, and the like as a consequence of the incomplete combustion of hydrocarbon fuels and the accompanying formation of nitrogen oxide. These investigations have led to the use of several catalytic systems and filters which receive the gases and the smoke of combustion. It is known to use complex catalytic agents formulated on the basis of noble metals such as platinum and palladium as well as several transition metals, with varying degrees of success.

By means of the above mentioned processes, an attempt is made to resolve the problem of environmental contamination, by correcting the composition of the gases and smoke caused by the combustion, leaving aside the causes which produce these contaminants. The solution of this problem admits of another alternative, namely enrichment of the fuels with certain additives, considered in general as catalytic agents in relation to oxidation of the fuel in an internal combustion engine, particularly in relation to the conversion of CO to CO2, the oxidation of intermediate elements arising from the partial oxidation of the hydrocarbons, and/or the reoxidation of carbon (soot) etc. Among the additives already tested, and the use of metal alcoholates of Groups 1A and 2A (particularly in the methoxide of sodium in a solution of anhydrous ethyl alcohol and tetraethyl lead. The latter composition has been shown to have adverse environmental effects as well.

SUMMARY OF THE INVENTION

Briefly sated, the present invention offers a new useful and proved variant, based on the use of a product or additive which includes nitrate of ethanolamine as a catalytic agent for complete combustion of the hydrocarbon fuel, with the result of a reduced emission of soot and CO and an improvement in the performance of the engine, as well as improved economy of fuel.

An object of the present invention is the provision of a hydrocarbon fuel additive which includes nitrate of ethanolamine for the purpose of reducing the content of soot and CO in the combustion gases, in which the additive is the product of the reaction of nitrate of ammonium and ethanol, in the presence of mono-nitrobenzene or mono-nitroalkyl (C1–C.4) benzene, or a mixture of both, at temperatures not greater than 40–45° C., the nitrate derivative being used in a concentration of 1% to 3% by weight and the molar relation between the nitrate derivate/nitrate of ammonium being at least 0.05–0.1 dissolved in the fuel, in the proportion of 1 volume of the anhydrous ethanol solution, prepared, starting from 1 mol of nitrate of ammonium —0.15 mols of mono-nitrobenzene, to at least 3000 volumes of fuel.

Another object of this invention is the provision of a process of preparation of the additive which contains nitrate of ethanolamine, in which a reaction is produced in an anhydrous solution of ethanol, between nitrate of ammonium and ethanol in the presence of aromatic derivates of nitrate chosen from mono-nitrobenzene and mono-nitroalkyl (c.1–C.4) benzene, at temperatures not greater than 40°–45° C., when the nitroderivative is used in concentrations of 1% to 3% by weight and the molar proportion of nitroderivatives to nitrate of ammonium is at least 0.05–0.1.

A principal object of the present invention is the provision of an additive for hydrocarbon fuels capable of reducing the content of smoke and CO in motor vehicle exhaust gases, which includes an anhydrous ethanol solution, the product of the reaction between nitrate of ammonium and ethanol, in the presence of mono-nitrobenzene or mono-nitroalkyl (C.1–C.4) benzene, or a mixture of both at temperatures not greater than 40°–45° C., the nitroderivative being used in a concentration of 1 to 3% by weight and the ammonium being at least 0.05–0.1.

Any of the mono-nitroderivatives included under the denomination of nitrobenzene or alkyl (C.1–C.4) benzene are useful for the purposes of the present invention. Although nitrobenzene is preferred, it is possible also to apply any of the mono-nitrotoluol isomers, including the xylene mononitrates.

The reaction is carried out at normal room temperature or by heating slowly to a temperature of up to 35°–45. C. Above this limit, the reaction may become uncontrollable. It is convenient to add to the reaction, dehydrating agents in order to retain the water formed in the course of the reaction and to shift the equilibrium to the side of the products, in order to favor the output. Sodium sulfate or anhydrous magnesium are recommended, including the zeolites and silica gel.

DETAILED DESCRIPTION OF THE DISCLOSED EMBODIMENT

The following example, given by way of explanation, includes a preferred form. It will be understood by those skilled in the art that multiple variations are possible.

EXAMPLE I

To a two liter glass flask having three inlets, with mixing means, the flask being placed in a bath of water at 25° C., there is first added one liter of anhydrous ethanol. Thereafter, there is added gradually 76 grs. of nitrate of ammonium p.a., the mixture being continuously agitated Once all of the nitrate of ammonium is dissolved, which is the point of saturation, 15 ml. of mono-nitrobenzene is added while continuously stirring.

Once the addition of mono-nitrobenzene is completed, there is subsequently added 30 grs. of anhydrous sulfate of sodium, while maintaining the mixture under agitation for approximately 6 hours, during which period of time the crystallization and separation of the anhydrous sulfate of sodium is accomplished.

After filtration a pale yellow, transparent and aromatic filtrate is obtained which may be used directly as an additive for common or special gasoline, kerosene, diesel oil, not only for internal combustion engines, but for heating fuels used in boilers, furnaces and the like, in the proportion of up to 6 parts per thousand by volume.

It has been demonstrated that this additive is markedly efficient in the reduction of formation of carbonaceous particles in the exhaust gases as well as the reduction of formation of CO, with a verified increase of up to 8% in the yield of the fuel with improved anti-knock qualities.

Tested in a diesel powered light truck, the additive was admixed one part to three thousand parts of fuel. Two trips, each of two kilometers were attempted. In the first trip, untreated fuel was employed, with the resultant obtaining of an index of 3 on the Bacharach scale. On a second trip, with the use of the additive, the Bacharach index was reduced to 2.

On a subsequent trial, using a Mercedes Benz, diesel powered, with automatic gearbox, the treated fuel, when compared with untreated fuel provided a reduction of fuel consumption of 8%, with the exhaust gases almost clear. A third trial involved a bench test of a diesel motor to determine maximum available torque without knocking. It was determined that using the additive, available torque was improved by approximately 10%.

I wish it to be understood that I do not consider the invention to be limited to the precise details disclosed in the above specification, for obvious modifications will occur to those skilled in the art to which the invention pertains.

I claim:

1. An additive for hydrocarbon fuels, capable of reducing smoke and carbon monoxide in exhaust gases consisting of the product of a reaction of nitrate of ammonium and anhydrous ethanol, in the presence of a nitroderivative selected from the group consisting of mono-nitrobenzene and mono-nitroalkyl (C-1–C-4) benzene or a mixture of the same at a temperature of not more than 40–45 degrees C., the nitroderivative being in a concentration of 1 to 3% by weight, the molar relation between the nitroderivatives and nitrate of ammonium being at least 0.05–0.1 to 1.

2. An additive in accordance with claim 1, in which the nitroderivative is mono-nitrobenzene.

3. An additive in accordance with claim 1, in which the nitroderivative is 3- or 4- nitrotoluol.

4. An additive in accordance with claim 1, in which the anhydrous ethanol is initially in absolute alcohol, which is dehydrated by the addition of agents to absorb water formed in the course of the reaction, selected from the group comprising sulfate of sodium, sulfate of magnesium, anhydrous calcium, silica gel and zeolites.

5. A hydrocarbon fuel of improved combustion comprising the additive defined in claim 1 in the proportion of 1 volume of the additive to at least 3000 volumes of fuel.

6. A hydrocarbon fuel in accordance with claim 5, in which the said proportion is of one volume of additive to 6000 volumes of fuel.

7. A process for the preparation of an additive for hydrocarbon fuels for reducing smoke and carbon monoxide in exhaust gasses consisting of the steps of:

a) heating anhydrous ethanol to approximately 25 degrees C.;

b) gradually adding approximately 76 grams of nitrate of ammonium per liter of anhydrous ethanol while continuously agitating the mixture;

c) at a point when all of the nitrate of ammonium is dissolved in the ethanol, adding 15 milliliters of a nitroderivative per liter of ethanol selected from the group consisting of mono-nitrobenzene, mono-nitroalkyl (C-1–C-4) benzene and mixtures thereof, while continuously agitating;

d) subsequently adding approximately 30 grams per liter of ethanol of a dehydrating agent in sufficient quantity to retain substantially all of the water produced during reaction, and allowing the dehydrating agent to crystallize;

e) thereafter, separating the dehydrating agent.

8. The process set forth in claim 7, in which the dehydrating agent is selected from the group consisting of: anhydrous sodium sulphate, anhydrous magnesium, and silica gel.

* * * * *